United States Patent [19]

Katzmann

[11] Patent Number: 4,854,242

[45] Date of Patent: Aug. 8, 1989

[54] SABOT PROJECTILE CONTAINING A PROJECTILE CORE AND A SABOT JACKET

[75] Inventor: Harald Katzmann, Neuenhof, Switzerland

[73] Assignee: Wekzeugmaschinenfabrik Oerlikon-Bührle AG, Zürich, Switzerland

[21] Appl. No.: 191,694

[22] Filed: May 9, 1988

[30] Foreign Application Priority Data

May 21, 1987 [CH] Switzerland ..... 01 972/87

[51] Int. Cl.[4] ..... F42B 13/00; F42B 13/16

[52] U.S. Cl. ..... 102/522; 102/506; 102/517

[58] Field of Search ..... 102/506, 517–523

[56] References Cited

U.S. PATENT DOCUMENTS

| | | | |
|---|---|---|---|
| 252,489 | 1/1882 | Mefford | 102/517 |
| 644,361 | 2/1900 | Luciani | 102/523 |
| 1,017,928 | 2/1912 | Tocik | 102/506 |
| 3,496,869 | 2/1970 | Engel | 102/522 |

FOREIGN PATENT DOCUMENTS

| | | | |
|---|---|---|---|
| 51375 | 5/1982 | European Pat. Off. | 102/517 |
| 073385 | 11/1986 | European Pat. Off. . | |
| 2202275 | 5/1974 | France . | |
| 305149 | 4/1955 | Switzerland . | |
| 305150 | 4/1955 | Switzerland . | |
| 305151 | 4/1955 | Switzerland . | |
| 360312 | 3/1962 | Switzerland . | |
| 2113810 | 8/1983 | United Kingdom . | |

*Primary Examiner*—Harold J. Tudor

*Attorney, Agent, or Firm*—Werner W. Kleeman

[57] ABSTRACT

For the projectile core of a sabot projectile, it is desired to use very brittle material in consideration of the strived for effect in the target. It has been found that a projectile core formed of a brittle material already tends to break while being delivered to the firing weapon. To avoid this danger, the brittle part of the projectile core is prestressed or pre-biased by a tie rod. The projectile core preferably consists of three components, wherein the intermediate component is prestressed and the contact surfaces between these three components are substantially conically structured.

6 Claims, 2 Drawing Sheets

SABOT PROJECTILE CONTAINING A PROJECTILE CORE AND A SABOT JACKET

BACKGROUND OF THE INVENTION

The present invention broadly relates to ammunition rounds or ordnance for firing weaponry and, more particularly, concerns a new and improved construction of a sabot projectile containing a projectile core and a sabot jacket.

In its more specific aspects, the sabot projectile of the present development is of the type comprising a projectile core and a sabot jacket. The sabot projectile has secured at the rear thereof a sabot tail or tail portion and at the front thereof a sabot hood member or element. The projectile core comprises three components or parts which are fabricated from different materials and the intermediate component or part of these three components or parts of the projectile core is prestressed or pre-biased by a tie or tension rod.

As disclosed in the European Patent No. 0,073,385, published Nov. 12, 1986, it is known to use a projectile core formed of tungsten for such projectiles. In particular, so-called frangible tungsten is used, the compressive strength of which is ten to twenty times greater than its tensile strength. Such a projectile core formed of tungsten with a very small elongation, which is approximately zero, cannot be fired in conventional manner out of firing weapons having a high firing rate or cadence, because there is the danger that, the projectile core already breaks or fractures when the projectile is delivered to the firing weapon. High deceleration forces arise when the projectile is delivered to the firing weapon and, particularly, when the projectile is rammed into the weapon barrel. These deceleration forces produce tensile stress in the projectile core. The projectile core can be prematurely destroyed by such tensile stress.

Furthermore, an explosive body known from the Swiss Patent No. 305,149, granted Feb. 15, 1955, possesses splitters embedded in a binding material or mass. In this explosive body, the part or component containing the splitters is at least partially in a state of compression by the action of an elastically stressed mechanical means. This part or component containing the splitters is preferably a cylinder-shaped hollow body which is likewise prestressed by a tie or tension rod. This cylinder-shaped hollow body comprises at both ends thereof two end faces or surfaces which are disposed parallel to each other and at which the tie or tension rod engages in order to produce a prestress.

It has been found that with parallel end faces or surfaces there is the danger that the cylinder-shaped hollow body breaks or fractures because of the prestress.

SUMMARY OF THE INVENTION

Therefore with the foregoing in mind it is a primary object of the present invention to provide a new and improved construction of a sabot projectile which is not afflicted with the aforementioned drawbacks and shortcomings of the prior art constructions.

Another important object of the present invention is directed to the provision of a new and improved construction of a sabot projectile containing a projectile core structured such that it can endure a high prestress or pre-bias without the danger existing that the projectile core breaks or fractures under the action of the prestress.

A further significant object of the present invention is directed to a new and improved construction of a sabot projectile of the aforementioned type, which is of relatively simple construction and design, and can therefore be economically fabricated.

Now in order to implement these and still further objects of the invention, which will become more readily apparent as the description proceeds, the sabot projectile of the present invention is manifested, among other things, by the features that the intermediate component or part comprises two substantially conically formed end faces or surfaces which possess a cone angle $\alpha$ smaller than 180°, and at these conically formed end faces or surfaces there bear the other two components or parts of the projectile core. These other two components or parts each comprise a substantially conically formed or shaped end face or surface which possesses a cone angle $\beta$ larger or greater than 180° and these cone angles $\alpha$ and $\beta$ complement one another to form 360°. The substantially conically formed or shaped end faces or surfaces of the other two components bear at the related or associated end face or surface of the intermediate component or part.

This construction of the projectile core has the following advantages:

Because of the substantially conical end faces or surfaces at both ends of the intermediate component or part there is a focusing or concentration of the pressure and shock waves when the projectile impacts at and penetrates into a target. This results in a higher penetration performance at lightly armored targets, a delayed breaking or fracture of the brittle or breakable intermediate component or part of the projectile core, and thus, a greater depth effect, which means a greater volume of destruction in unarmored targets, and, in addition, an improvement of the centering of the intermediate component or part when the three components or parts are assembled.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the sabot projectile containing a projectile core or penetrator and a sabot jacket has been illustrated therein as is needed for one skilled in the art to readily understand the underlying principles and concepts of the present invention.

Figure 1:
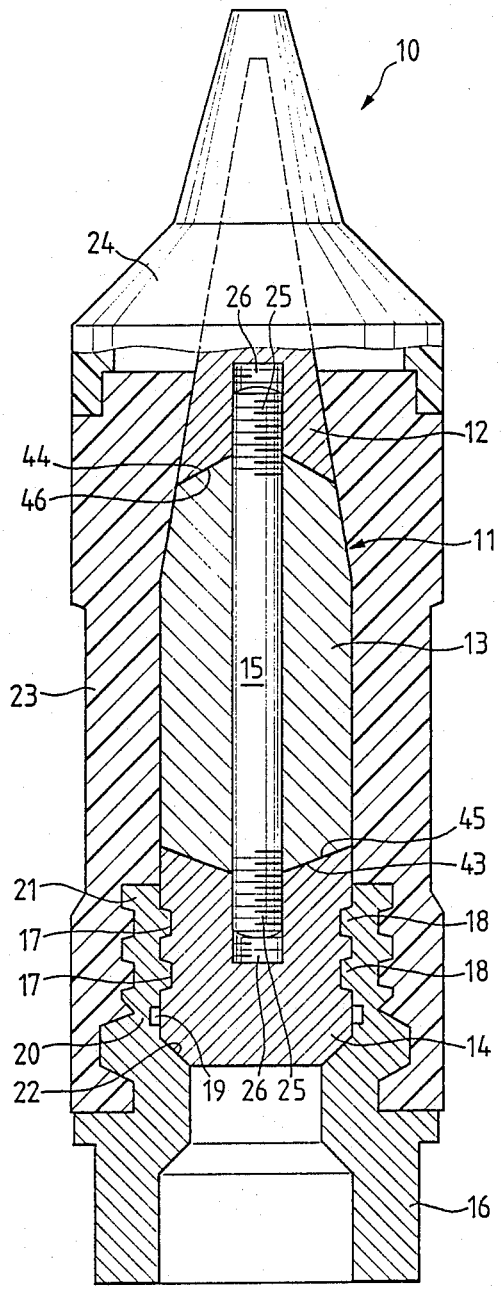
FIG. 1 is a longitudinal sectional view through a first embodiment of a sabot projectile containing a projectile core and constructed according to the teachings of the present invention.

Turning now to the accompanying drawings and specifically directing attention to FIG. 1 thereof, the exemplary embodiment of sabot projectile 10 depicted therein will be seen to comprise a projectile core 11. This projectile core 11 consists of three components or parts 12, 13 and 14 which are held together by a tie or tension rod 15 or equivalent structure. This tie or tension rod 15 is threaded or screwed in front or at its front region into the projectile core nose or tip 12 and in the rear or at its rear region into the projectile core tail or tail portion 14. As a result, it will be understood the projectile core nose 12, the intermediate component or part 13 and the projectile core tail 14 are pressed against each other such that the essentially cylindrical intermediate component or part 13 is under prestress or prebias, particularly in axial direction.

The essentially cylindrical intermediate component or part 13 comprises two end faces or surfaces 44 and 43 at which contactingly bear or rest the projectile core nose 12 and the projectile core tail 14. Both end faces or surfaces 43 and 44 are substantially conically formed or shaped, and the cone angle $\alpha$ of the intermediate component or part 13 is smaller than 180°. It will be seen that here and in the other embodiments, this cone angle $\alpha$ is measured through the body of the intermediate component or part 13.

The other two components or parts, namely the projectile core nose or tip 12 and the projectile core tail or tail portion 14, each possess an end face or surface 46 and 45 respectively, which bear or rest at the associated end faces or surfaces 44 and 43, respectively, of the essentially cylindrical intermediate component or part 13. These end faces or surfaces 45 and 46 are also substantially conically formed or shaped, and the cone angle $\beta$, as again measured here and in the other embodiments through the body of the components or parts 12 and 14, is larger or greater than 180°. These two cone angles $\alpha$ and $\beta$ complement one another to form 360° as can be seen from the drawings.

The projectile core 11 is inserted into an annular sabot tail or rear portion 16. Two circumferential grooves 17 are provided in the projectile core tail or tail portion 14 for securing the projectile core 11 in the sabot tail or rear portion 16. A plurality of cams or dogs or lugs 18 uniformly distributed at the circumference of the sabot tail or rear portion 16 project into the circumferential grooves 17. A reference fracture location 20 is formed at the sabot tail or rear portion 16 by an inner circumferential groove 19. Above this reference fracture location 20 the sabot tail or rear portion 16 possesses a plurality of tongue members 21 at each of which two cams or dogs 18 are located. When the sabot projectile 10 is fired, the projectile core 11 can be supported upon a substantially conical surface 22 of the sabot tail or rear portion 16. Furthermore, a sabot jacket 23 is secured at its rear portion at the sabot tail or rear portion 16 and a sabot hood member or element 24 is mounted upon the sabot jacket 23 at its front portion.

The sabot projectile 10 thus contains a sabot tail or rear portion or section 16, a sabot jacket 23 and a sabot hood member 24. However, this aspect of the sabot projectile 10 is not subject matter of the invention and therefore need not here be further considered in greater detail.

For the individual parts or components of the sabot projectile the materials listed hereinafter preferably should be used:

Frangible tungsten is preferably used for the intermediate component or part 13. The compressive strength of this frangible tungsten is ten to twenty times higher than its tensile strength. Therefore, this intermediate component or part 13 must be protected against tensile stress upon firing of the sabot projectile by the aforementioned prestress or pre-bias exerted by the tie or tension rod 15.

Steel or a tungsten alloy is suitable for the projectile core tail or tail portion 14.

Suitable material for the projectile core nose or tip 12 is steel, titanium, zirconium or a tungsten alloy.

Plastic material is suitable for the sabot hood member 24. Plastic material is also used for the sabot jacket 23. Only a light metal is suitable for the sabot tail or rear portion 16.

The tie or tension rod 15 is preferably formed of steel.

According to the embodiment of FIG. 1, this tie or tension rod 15 is provided at both opposite ends with a thread or thread means 25 and each such end is screwed or threaded into corresponding bores 26 of the projectile core tail 14 and the projectile core nose 12.

Figure 2:
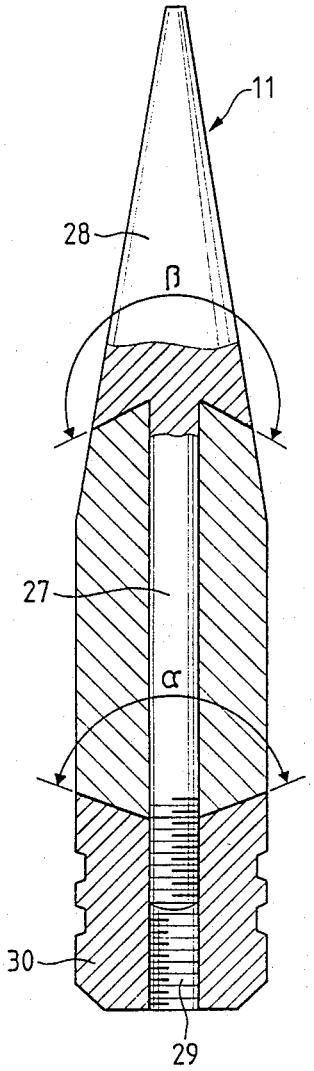
FIG. 2 is a longitudinal sectional view through a second embodiment of a projectile core constructed according to the teachings of the present invention.

According to the construction of FIG. 2, the tie or tension rod 27 is fabricated from one piece with the projectile core nose or tip 28 and screwed or threaded into a throughbore or open-ended bore 29 of the projectile core tail or tail portion 30.

Figure 3:
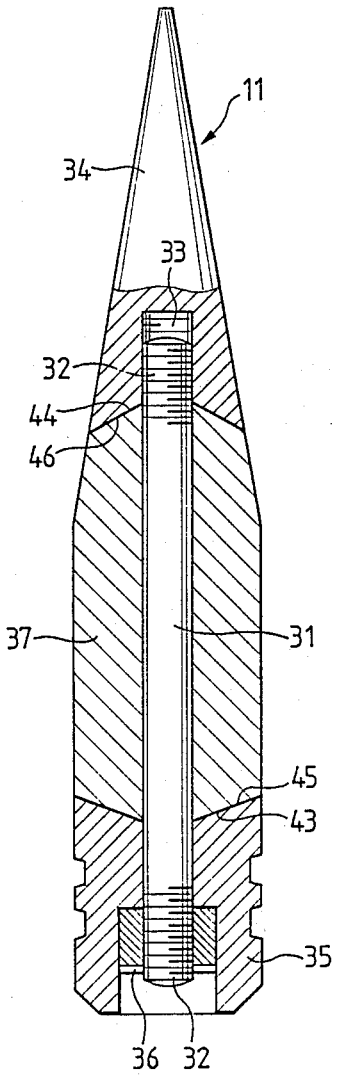
FIG. 3 is a longitudinal sectional view through a third embodiment of a projectile core constructed according to the teachings of the present invention.

The tie or tension rod 31 illustrated in the arrangement of FIG. 3 possesses at both ends a thread or thread means 32, is screwed or threaded at the front or front end into a bore 33 of the projectile core nose or tip 34 and projects at the rear or rear end into the projectile core tail or tail portion 35. A counternut 36 or the like is screwed or threaded onto the rear thread or thread means 32 of the tie or tension rod 31 and renders it possible to press together the projectile core nose 34, the projectile core tail 35 and the intermediate component or part 37 and to prestress or pre-bias the intermediate component or part 37.

Figure 4:
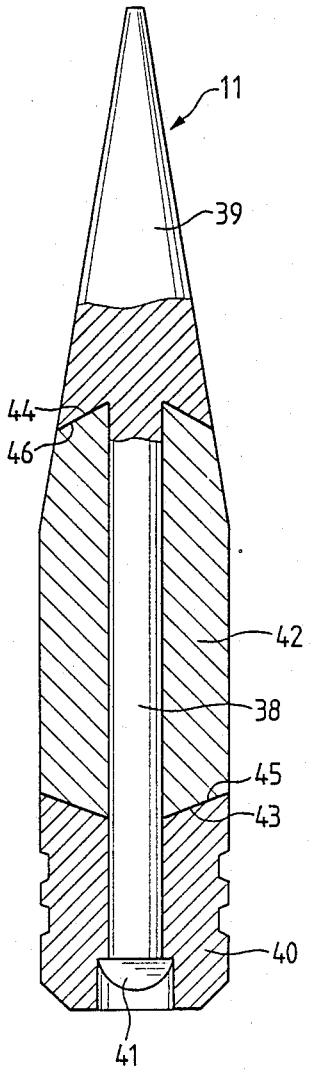
FIG. 4 is a longitudinal sectional view through a fourth embodiment of a projectile core constructed according to the teachings of the present invention.

According to the construction of FIG. 4, the tie or tension rod 38 is welded onto the projectile nose 39 and projects with its rear end into a bore of the projectile core tail or tail portion 40. This rear end of the tie or tension rod 38 is formed into a rivet head 41 or upset, and also in this embodiment a prestress or pre-bias is possible in the intermediate component 42 of the projectile core 11.

While there are shown and described present preferred embodiments of the invention, it is to be distinctly understood that the invention is not limited thereto, but may be otherwise variously embodied and practiced within the scope of the following claims. Accordingly,

What I claim is:

1. A sabot projectile, comprising:

a projectile core;

a sabot jacket surrounding the projectile core;

said sabot jacket having a front portion and a rear portion;

a sabot tail secured at the sabot jacket at the rear portion thereof;

a sabot hood member secured at the sabot jacket at the front portion thereof;

the projectile core comprising three components fabricated from different materials;

one of said three components constituting the intermediate component of the projectile core;

said intermediate component being made of a material which is frangible upon impact;

a tie rod extending through said intermediate component for interconnecting said three components of said projectile core;

prestressing means cooperating with said tie rod for prestressing said frangible material and thereby preventing premature fracturing of said frangible material of said intermediate component in the assembled state of said projectile core;

the other two of said three components respectively constituting a core nose and a core tail;

said intermediate component comprising two substantially conically shaped end faces, each of which possess a cone angle $\alpha$ smaller than 180°;

said core nose bearing against one of said two substantially conically shaped end faces and said core tail bearing against the other one of said two substantially conically shaped end faces;

said core nose comprising a substantially conically shaped end face which possesses a cone angle $\beta$ larger than 180° and bearing against said one substantially conically shaped end face of said intermediate component;

said core tail comprising a substantially conically shaped end face which possesses a cone angle $\beta$ larger than 180° and bearing against said other substantially conically shaped end face of said intermediate component; and said cone angle $\alpha$ and said cone angle $\beta$ complementing one another to form 360°.

2. The projectile as defined in claim 1, wherein:

said tie rod is provided at both ends with external thread means;

said core nose possesses internal thread means;

said core tail possesses internal thread means; and said tie rod being threadably connected by said external thread means with said core nose and said core tail by said internal thread means thereof.

3. The projectile as defined in claim 1, wherein:

said tie rod is integrally formed with said core nose and is provided at one end with external thread means;

said core tail possesses internal thread means; and said tie rod being threadably connected by said external thread means with said core tail by said internal thread means thereof.

4. The projectile as defined in claim 1, further including:

a counternut;

said tie rod being provided at both ends with external thread means;

said core nose possessing internal thread means;

said core tail which has said substantially conically shaped end face, possessing means defining a throughbore;

said tie rod being threadably connected at one end by said external thread means with said core nose by means of said internal thread means thereof;

said tie rod projecting through said means defining the throughbore in said core tail and being secured to said core tail by means of said counternut internally of said core tail; and said threadable connection formed between said one end of said tie rod and the core nose in conjunction with said counter nut securing said tie rod internally of said core tail constituting said prestressing means cooperating with said tie rod for prestressing said frangible material of said intermediate component in the assembled state of said projectile core.

5. The projectile as defined in claim 1, wherein:

said tie rod is secured at one end to said core nose;

said core tail having means defining a throughbore; and said tie rod projecting through said throughbore at the rear end of said tie rod and being formed to define a rivet head.

6. A projectile core structure, comprising:

projectile core means;

the projectile core means comprising three components;

one of said three components constituting the intermediate component of the projectile core;

said intermediate component being made of a material which is frangible upon impact;

a tie rod extending through said intermediate component for interconnecting said three components of said projectile core means;

prestressing means cooperating with said tie rod for prestressing said frangible material and thereby preventing premature fracturing of said frangible material of said intermediate component in the assembled state of said projectile core means;

the other two of said three components respectively constituting a core nose and a core tail;

said intermediate component comprising two substantially conically shaped end faces, each of which possess a cone angle $\alpha$ smaller than 180° measured through the intermediate component;

said core nose bearing against one of said two substantially conically shaped end faces and said core tail bearing against the other one of said two substantially conically shaped end faces;

said core nose comprising a substantially conically shaped end face which possesses a cone angle $\beta$ larger than 180° measured through the core nose and bearing against said one substantially conically shaped end face of said intermediate component;

said core tail comprising a substantially conically shaped end face which possesses a cone angle $\beta$ larger than 180° measured through the core tail and bearing against said other substantially conically shaped end face of said intermediate component; and said cone angle $\alpha$ and said cone angle $\beta$ complementing one another to form 360°.

* * * * *